US011779088B2

(12) United States Patent
Calleija

(10) Patent No.: US 11,779,088 B2
(45) Date of Patent: Oct. 10, 2023

(54) PAD FOR TIGHTENING A RING UPON A FINGER, AND METHODS AND KIT RELATING THERETO

(71) Applicant: CALLEIJA INVESTMENTS (QLD) PTY LTD, Gold Coast (AU)

(72) Inventor: John Calleija, Gold Coast (AU)

(73) Assignee: CALLEIJA INVESTMENTS (QLD) PTY LTD, Main Beach (AU)

( * ) Notice: Subject to any disclaimer, the term of this patent is extended or adjusted under 35 U.S.C. 154(b) by 140 days.

(21) Appl. No.: 17/259,656

(22) PCT Filed: Jul. 12, 2019

(86) PCT No.: PCT/AU2019/050731
§ 371 (c)(1),
(2) Date: Jan. 12, 2021

(87) PCT Pub. No.: WO2020/010404
PCT Pub. Date: Jan. 16, 2020

(65) Prior Publication Data

US 2021/0315334 A1 Oct. 14, 2021

(30) Foreign Application Priority Data

Jul. 13, 2018 (AU) ..... 2018902538

(51) Int. Cl.
*A44C 9/02* (2006.01)

(52) U.S. Cl.
CPC ..... *A44C 9/02* (2013.01)

(58) Field of Classification Search
CPC ..... A44C 9/02; A44C 9/0084; A44C 27/00
(Continued)

(56) References Cited

U.S. PATENT DOCUMENTS 3,214,939 A * 11/1965 Monahan ..... A44C 9/0084 446/901
3,557,571 A * 1/1971 Santo ..... A44C 9/0084 63/15.6

(Continued)

FOREIGN PATENT DOCUMENTS

EP 2586325 1/2013
JP H0929914 2/1997

(Continued)

OTHER PUBLICATIONS

Japanese Patent Office, Office Action/Examination issued for Japanese Patent Application No. 2021-524078 dated May 30, 2023.

*Primary Examiner* — Jack W Lavinder
(74) *Attorney, Agent, or Firm* — Galgano IP Law PLLC; Thomas M. Galgano; Edwin D. Schindler

(57) ABSTRACT

The present invention relates to a pad to be applied to an inner surface of a finger-ring, comprising an elastically compressible pad body and an adhesive layer adapted to adhere to the inner surface of the finger-ring, wherein, upon the finger-ring being worn upon a finger, the pad body is compressed, and the compressed pad body urges against the finger, such that rotation or movement of the finger-ring about or along the finger is inhibited. The present invention further relates to a method of use thereof, a method of formation thereof and a kit comprising an embodiment of the pad of the present invention.

14 Claims, 6 Drawing Sheets

(58) Field of Classification Search
USPC ..... 29/896.41, 896.412
See application file for complete search history.

(56) References Cited

U.S. PATENT DOCUMENTS

| | | | | | |
|---|---|---|---|---|---|
| 4,064,313 | A * | 12/1977 | Takiguchi | C08K 5/11 | 430/124.38 |
| 5,253,491 | A * | 10/1993 | Buontempo | A44C 9/02 | 63/15.6 |
| 5,261,256 | A * | 11/1993 | Ellenbecker | A44C 9/02 | 63/15.5 |
| 5,628,208 | A * | 5/1997 | Rood | A44C 9/02 | 63/15.5 |
| 6,099,539 | A * | 8/2000 | Howell | A61B 17/122 | 606/151 |
| 6,481,114 | B1 * | 11/2002 | Kalajian | A44C 9/02 | 33/544.4 |
| 6,672,105 | B1 * | 1/2004 | Sills | A44C 9/02 | 63/15.5 |
| 7,797,964 | B1 * | 9/2010 | Lynch | A44C 9/02 | 24/574.1 |
| 2011/0166498 | A1 * | 7/2011 | Shantha | A61M 5/427 | 604/20 |
| 2011/0289966 | A1 | 12/2011 | Ahrenholtz et al. | | |
| 2012/0030909 | A1 | 2/2012 | Moore et al. | | |

FOREIGN PATENT DOCUMENTS

| | | | |
|---|---|---|---|
| JP | 2004-12649 | A | 1/2004 |
| JP | 2008295526 | | 12/2008 |
| JP | 2013031620 | | 2/2013 |
| WO | WO 2006/057199 | A1 | 6/2006 |

* cited by examiner

PAD FOR TIGHTENING A RING UPON A FINGER, AND METHODS AND KIT RELATING THERETO

PRIORITY DETAILS

The present application claims priority from provisional application No. 2018902538, filed in Australia on 13 Jul. 2018, the entirety of which is incorporated herein by reference.

TECHNICAL FIELD

The present invention relates generally to the field of jewellery and in particular to rings worn upon a person's finger. More particularly, the present invention relates to providing a means of preventing a finger-worn ring from rotating about a finger and/or from sliding off of the finger.

BACKGROUND

Rings worn on the finger are known to be susceptible to rotation and slippage, particularly if the ring is slightly too large for the finger it is worn upon. A ring that is slightly too large is sometimes necessary however, particularly for people who have knuckles that are substantially wider than their fingers, for example people suffering from arthritis.

Prior art means of ring tightening and preventing slippage and/or rotation are known, but these are either temporary solutions, or are devices that extend partway around the side of the ring, which are visible and thereby fail to be discreet. Other prior art means are known, such as ring sizing beads. However these involve soldering on small beads of metal to the inside of the ring, which requires an expert jeweller to insert and solder into position and provide no cushioning or 'give', and so may be uncomfortable to wear. Furthermore, ring sizing beads are a semi-permanent solution and can be difficult to adjust or remove without damaging the finger ring.

It would therefore be desirable to provide a means of preventing a ring from rotating out of alignment or from slipping off of a finger upon which it is worn.

DISCLOSURE OF THE INVENTION

In a first aspect, the present invention relates to a pad to be applied to an inner surface of a finger-ring, the pad comprising an elastically compressible pad body, and an adhesive layer adapted to adhere to the inner surface of the finger-ring, wherein, upon the finger-ring being worn upon a finger, the pad body is compressed, and the compressed pad body urges against the finger, such that rotation or movement of the finger-ring about or along the finger is inhibited.

In an embodiment, the pad body is comprised of one or more polysiloxanes. In a further embodiment, the one or more polysiloxanes are in the form of one or more of silicone rubber, silicone resin, silicone foam and silicone sponge.

In a further embodiment, the pad further comprises a pad base between the pad body and the adhesive layer, the pad base being configured to engage with and retain the pad body. In a further embodiment, the pad base comprises one or more engageable surface features that engage with and retain the pad body. In a further embodiment, at least one of the engageable surface features comprises one or more of a contusion, protrusion or ridge inserted with or otherwise contacted with the pad body in a liquid, gel or putty state, and upon the pad body setting, curing or otherwise transitioning into a solid state, the pad body engages with, and is retained against the pad base by, the engageable surface feature.

In an embodiment, the adhesive layer is a polysiloxane adhesive that is one of a liquid, gel or putty, and the liquid, gel or putty polysiloxane adhesive is configured to set into a solid polysiloxane, thereby adhering the pad body to the inner surface of the finger-ring. In an alternate embodiment, the adhesive layer comprises a non-polysiloxane-based adhesive.

In an embodiment, the pad body further comprises a plurality of ridges on a finger-contacting surface of the pad body. In a further embodiment, the plurality of ridges are formed as protrusions of the pad body. In an embodiment, the pad body is sized to cover substantially all of the inner surface of the finger-ring.

A second aspect of the present invention relates to a method of preventing a finger-ring from rotating about or slipping off a finger on which the finger-ring is worn, the method comprising the steps of: applying at least one pad comprising an elastically compressible pad body and an adhesive layer to a portion of an inner surface of the finger-ring, whereby the adhesive layer adheres to the inner surface portion, allowing the adhesive layer to set, and placing the finger-ring upon the finger, thereby compressing the pad body, wherein the compressed pad body urges against the finger, preventing rotation or movement of the finger-ring about the finger.

In an embodiment, the pad body is comprised of one or more polysiloxanes, the adhesive is a non-polysiloxane-based adhesive, and the pad further comprises a pad base between the pad body and the adhesive layer, the pad base engaging with and retaining the pad body.

In an embodiment, the adhesive layer is a liquid, gel or putty polysiloxane adhesive and the inner surface comprises a precious metal or other material that polysiloxane adhesive does not adhere to, the method additionally comprises the step of prior to the step of applying the pad body to the inner surface portion of the ring, applying an etching primer to a portion of the inner surface of the finger ring so as to prime the inner surface portion, wherein the step of priming the inner surface portion enables polysiloxane adhesive to adhere to the precious metal or other material.

In an embodiment wherein the pad is not provided with an adhesive layer, the method additionally comprises the step of, prior to the step of applying the pad body to the inner surface portion of the ring, applying an adhesive material to the pad body so as to form an adhesive layer.

A third aspect of the present invention relates to a method of producing a polysiloxane pad body to be applied to an inner surface of a finger-ring, the method comprising the steps of: pouring, injecting or otherwise inserting liquid, gel or putty polysiloxane into a mould, enabling the polysiloxane to set such that it forms into a solid polysiloxane pad body, and removing the formed pad body from the mould.

In an embodiment, the method further comprises the step of: prior to the step of enabling the polysiloxane to set, contacting a pad-receiving side of a pad base with the liquid, gel or putty polysiloxane such that at least one engageable surface feature of the pad base is at least partially immersed within the polysiloxane, wherein, upon the polysiloxane setting to form a solid pad body, the pad body engages with and is retained against the pad base.

A fourth aspect of the present invention relates to a kit for a user to attach a pad to a finger-ring, comprising a pad having a pad body and adhesive material to form an adhesive layer. In an embodiment wherein the pad body is comprised of polysiloxane or a polysiloxane-based material, the kit further comprises a pad base in engagement with the pad body, and the pad base comprises an adhesive-receiving side for the adhesive material to be applied thereto so as to form an adhesive layer.

In an embodiment, the adhesive material is provided as an adhesive layer, the kit further comprising an adhesive-preserving seal covering the adhesive layer.

DESCRIPTION OF FIGURES

Embodiments of the present invention will now be described in relation to figures, wherein.

DEFINITIONS

As used herein, the term 'finger-ring' is to be interpreted as an item of jewellery that is designed to be worn upon a finger or toe, and may be more commonly referred to as simply a 'ring'. A finger-ring typically comprises a loop of material (often one or more metals) through which a finger or toe is passed, so that the ring encircles the finger or toe. The loop is typically referred to as a 'band'. The ring may further include decorative features such as a setting (with one or more stones), engravings, side stones and other features.

DETAILED DESCRIPTION OF PREFERRED EMBODIMENTS

Generally, in a first aspect the invention concerns a pad to be applied to at least a portion of an inner surface of a finger-ring, hereinafter referred to generically as a 'ring'. In at least one broad embodiment, the pad comprises an elastically compressible pad body that is adapted to compress when a force is applied thereto.

Figure 1A:
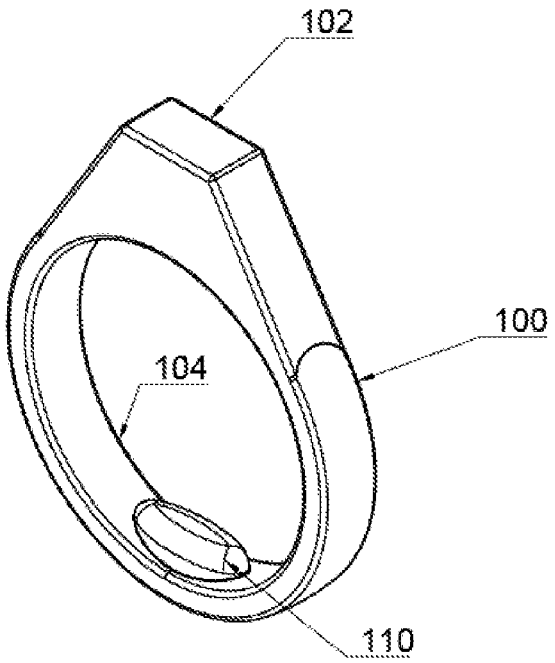
FIGS. 1A & 1B depict an embodiment of a pad of the present invention.
Figure 1B:
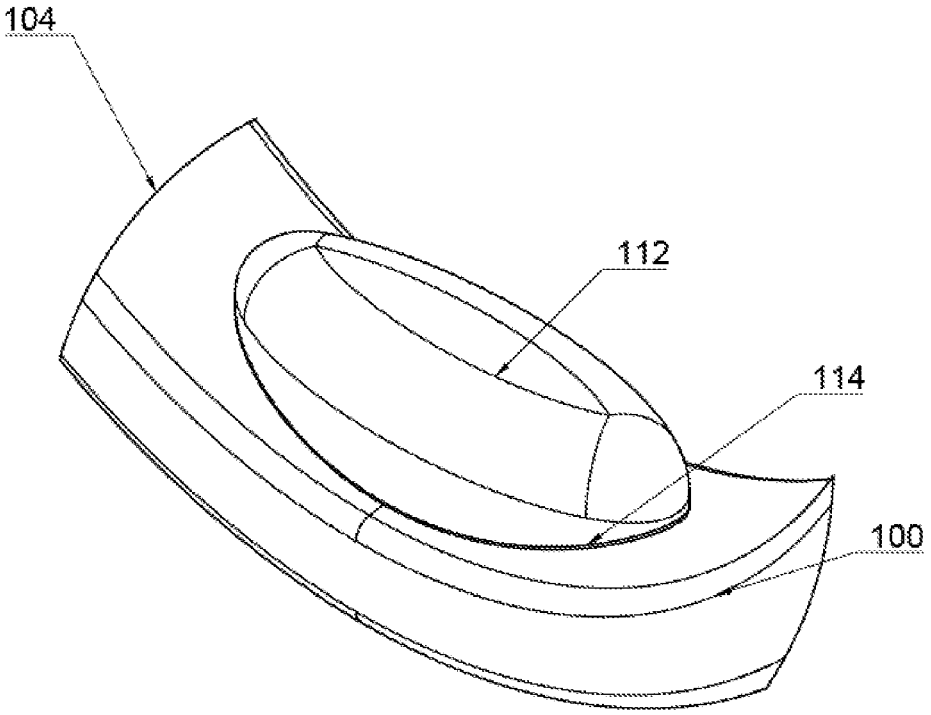

With reference to FIGS. 1A & 1B, depicted is a ring 100 having a setting 102 and an inner surface 104. A pad 110 is attached to the inner surface 104. In an embodiment, the pad 110 generally comprises a compressible pad 110 body and an adhesive layer. The pad 110 body is typically comprised of an elastically deformable and compressible material, whereupon application of a force, the pad 110 body will compress, and upon removal of the applied force the pad 110 body will revert to its original shape. A pad 110 comprising an elastically deformable material in the pad 110 body will therefore, in at least one embodiment, provide a measure of cushioning to any object that presses upon the pad 110.

Without limiting the scope of the invention through theory, it is considered that the pad 110 of at least an embodiment of the present invention provides a significant advantage over prior art ring tightening means such as prior art ring inserts. In at least the present embodiment, the pad 110 is configured to compress and expand as a finger is inserted into or removed from a ring, and it is considered that the compressibility of the pad 110 improves both the life of the pad 110 and the contact between the pad 110 and an inserted finger. In contrast, prior art ring inserts typically flex, which may induce shear forces across any adhesive layers, thereby potentially reducing the lifespan. Flexed ring inserts also tend to be uncomfortable to the person wearing 100 the ring, as there may be the sensation of the ring not sitting 'square', or of the flexed insert 'dragging' on the skin of the finger.

In one embodiment, the pad body 112 is comprised of one or more polysiloxanes. The polysiloxanes may be in the form of one or more of silicone rubber, silicone resin, silicone foam and silicone sponge. Without limiting the scope of the invention, polysiloxanes are considered to be a particularly advantageous material for the pad body 112 due to their desirable properties. Polysiloxanes are typically both chemically and thermally stable and are also non-toxic, as well as resistant to corrosion and damage from exposure to air and light. Polysiloxanes are also non-supportive of microbial growth and are highly resistant to and repellent of water, enabling a pad 110 of the present invention to be easily and readily cleaned and hygienically maintained.

Embodiments of the Adhesive Material

In an embodiment, the adhesive layer 114 comprises an adhesive material that can bond to both the material of the pad body 112 and to the inner surface 104 of the ring. It is preferable that the adhesive material is non-corrosive and otherwise non-reactive beyond setting 102 or curing 100 to form an adhesive bond, so as to alleviate the risks of damaging a ring 100 to which the pad 110 is applied.

As the skilled person will appreciate, there are three primary means through which an adhesive bond between an object and a surface may fail. The bond may fail between the object, e.g. the pad body 112, and the adhesive layer 114 ('Object-adhesive failure'); the surface, e.g. the inner surface 104 of the ring, and the adhesive layer 114 ('Surface-adhesive failure'); or the adhesive layer 114 may fracture, improperly or inadequately cure or otherwise fail ('internal failure').

Polysiloxane-Based Adhesive Material

In one preferred embodiment of the present invention, the adhesive material is at least partially a polysiloxane or polysiloxane-based adhesive. In at least the present embodiment, the polysiloxane adhesive is a liquid, gel or putty, and is configured to set or cure into a solid polysiloxane. When used as an adhesive and the pad 110 is applied to an inner surface 104 of the ring 100, the liquid, gel or putty polysiloxane sets or cures into a solid polysiloxane layer between the pad body 112 and the inner surface 104 of the ring 100, bonding to both the pad body 112 and the inner surface 104 of the ring 100 and thus adhering 100 one to the other.

The embodiment wherein the adhesive material is at least partially polysiloxane is considered to be advantageous in that the resulting adhesion is flexible and long-lasting. Polysiloxane compounds are also highly regarded for their resilience against thermal and/or chemical damage. Therefore, in an embodiment wherein the adhesive material is at least partially polysiloxane, the present invention may provide for a semi-permanent means of applying a pad 110 to an inner surface 104 of a finger-ring 100 and improving its ability to be retained upon a finger. It is theorised that using a polysiloxane adhesive may allow for at least one embodiment of the present invention to inhibit, reduce or at least ameliorate the rate of 'internal failure' of the adhesive bond, due to the improved flexibility of the polysiloxane adhesive and its resistance to breakdown through thermal and/or chemical damage.

In an embodiment wherein the pad body 112 is at least partially comprised of polysiloxanes, it may be particularly advantageous to use a polysiloxane-based adhesive to form the adhesive layer 114. Without limiting the scope of the invention through theory, it is theorized that the strength of the adhesion between pad body 112 and ring 100 may be improved when the adhesive material is chemically similar to that of the pad body 112 (i.e. both adhesive layer 114 and pad body 112 are polysiloxanes), as the adhesive material will more readily bond with the pad body 112. Therefore, in one particular embodiment, both the pad body 112 and adhesive material are at least partially comprised of polysiloxanes. In at least this embodiment, the polysiloxane adhesive may cure to form a high-strength bond with the polysiloxane pad body 112 due to the similarities in chemical properties. It is theorised that this may enable at least one embodiment of the present invention to inhibit, reduce or at least ameliorate the rate of 'object-adhesive failure'.

In a further embodiment, the pad body 112 and adhesive material are comprised of polysiloxanes having substantially similar chemical formulae and properties. As the skilled person may appreciate, there are a wide variety of polysiloxanes, and the compatibility between any two may vary. In some circumstances it may be necessary to improve the compatibility between adhesive and pad body 112 by using substantially similar polysiloxanes for both, thereby further improving the strength of the bond between adhesive layer 114 and pad body 112 and further inhibiting, reducing or at least ameliorating the rate of 'object-adhesive failure'.

Surface Treatment of the Ring

In an embodiment, the inner surface 104 of the ring 100 may require treatment in order to facilitate application and curing 100 of an adhesive, so as to address the rate of 'surface-adhesive failure'. Many rings are manufactured using either precious metals such as gold, silver, platinum and others, or are otherwise formed of materials that are substantially inert with respect to adhesives. These rings will not readily accept an adhesive, and so the adhesive layer 114 is unlikely to cure and form a suitable adhesive bond. In such an embodiment, the present invention may further comprise a primer to be applied to the portion of the inner surface 104 where the pad body 112 is to be attached. The primer may be an etching primer. This may enable an adhesive to properly adhere to the inner surface 104 portion of the ring 100, and thereby may inhibit, reduce or at least ameliorate the rate of 'surface-adhesive failure' of the adhesive bond.

In an embodiment wherein the adhesive is polysiloxane or polysiloxane-based, the use of a surface treatment may be advantageous to improve the ability of the polysiloxane to bond with the material of the inner surface 104 of the ring. Without limiting the scope of the invention, it is theorised that treating the ring 100 with a primer such as an etching primer disrupts the otherwise smooth surface of the inner surface 104 of the ring 100. It is further theorised that this may act to enable, encourage or otherwise facilitate chemical bonding between the polysiloxane-based adhesive and the material of the inner surface 104 of the ring 100 that is otherwise substantially inert with respect to polysiloxane-based adhesives.

Adhesives Other than Polysiloxane and a Pad Base

In an alternate embodiment of the present invention, the adhesive material may comprise an adhesive other than a polysiloxane-based adhesive. The adhesive may comprise a polymer-based adhesive, a resin-type adhesive, an epoxy adhesive or any other form of adhesive that will form a semi-permanent bond to a metallic surface.

Figure 2A:
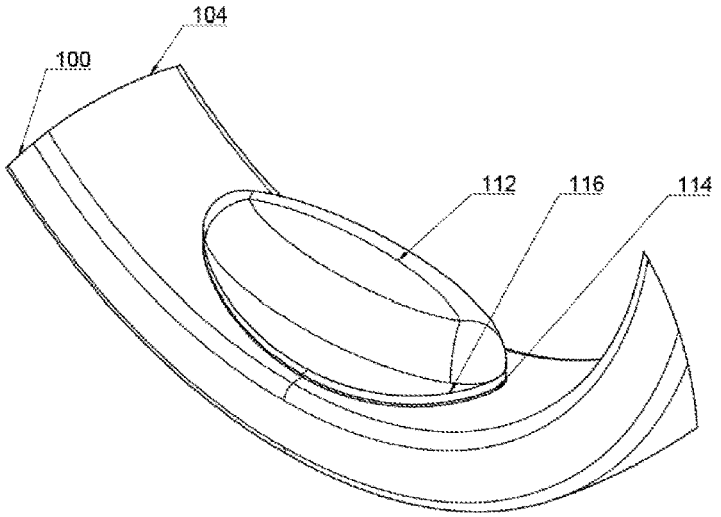
FIGS. 2A-2C depict an embodiment of a pad including a pad base.

In an embodiment wherein the pad body 112 is at least partially comprised of polysiloxanes, it may be disadvantageous or otherwise of limited benefit to use a polysiloxane-based adhesive. However, many non-polysiloxane-based adhesives do not readily bond with a polysiloxane object, and so the pad body 112 may not be able to be adhered to the inner surface 104 of the ring. In such an embodiment and with reference to FIG. 2A, the pad 110 of the present invention may further comprise a pad base 116, being an essentially flat segment of plastic or other suitable material having a pad-receiving side and an opposing adhesive-receiving side. In the present embodiment, the polysiloxane-based pad body 112 may fasten onto and engage with the pad-receiving side of the pad base 116, and the adhesive then adheres the pad base 116 to the inner surface 104 of the ring. Therefore, the adhesive is not required to bond with the polysiloxane of the pad body 112.

As has been previously established, polysiloxane-based compounds do not readily bond or adhere to many substances that are not themselves polysiloxane-based. Therefore, in at least one embodiment and with reference to FIGS. 2B & 2C, the pad-receiving side of the pad base 116 may have contusions, protrusions, ridges or other engageable surface features 118 shaped for the polysiloxane pad body 112 to grip onto. Without limiting the scope of the invention through theory, it is theorised that even though the polysiloxane may not directly bond with the material of the pad base 116, the provision of engageable surface features 118 may enable the polysiloxane to set, cure or otherwise transition into a solid form around, through, or otherwise engaged with the engageable surface features 118 of the pad-receiving side of the pad base 116. This may act to non-adhesively engage the pad body 112 with the pad base 116. The pad base 116 may then be adhered to the inner surface 104 of the ring. As the pad base 116 is formed of a material other than polysiloxane, it is theorised that this may enable the present embodiment of the invention to inhibit, reduce or at least ameliorate the rate of 'object-adhesive failure'.

Figure 2B:
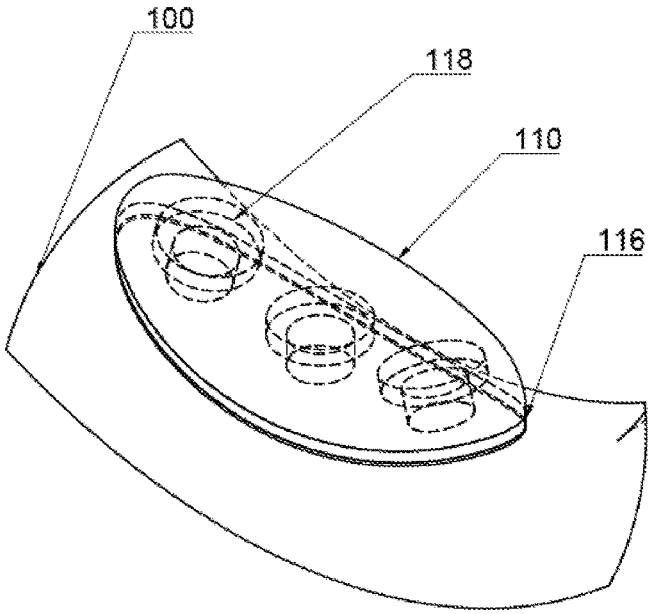
Figure 2C:
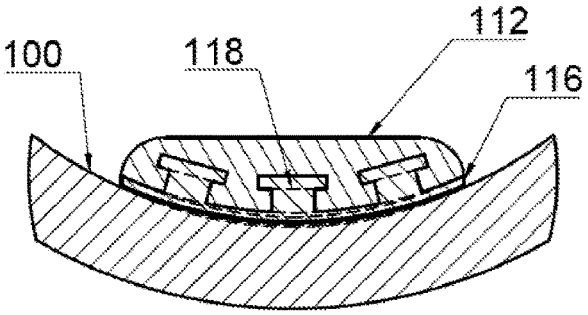

Turning specifically to the non-limiting embodiment shown in FIG. 2B, the engageable surface feature 118 comprises a stem with a wide cap. Upon the surface features 118 being immersed in liquid polysiloxane which is then solidified through one or more setting processes, the solidified polysiloxane of the pad body 112 may be non-adhesively engaged with the surface feature 118 and thus retained against the pad base 116. As the skilled person will appreciate, the surface feature may be of any suitable shape that enables the pad body 112 to engage with and be retained by the pad base 116 without departing from the scope of the invention.

In a further embodiment, the engageable surface features 118 may be at least partially hollow. This may enable adhesive material that is applied to the adhesive-receiving side of the pad base 116 to at least partially enter 'inside' the pad base 116. This may enable improved interaction of the pad base 116 with the adhesive material, and may promote improved adhesion of the pad base 116 to the inner surface 104 of the ring 100.

Applications of Embodiments of the Present Invention

One application of an embodiment of the pad 110 of the present invention is shown in FIG. 1. A ring 100 with a setting 102 is shown, with a single pad 110 of an embodiment of the present invention applied to an inner surface 104 of the ring. Although the ring 100 is shown with only a single pad 110, the skilled person will appreciate that any number of pads 110 may be attached to the inner surface 104 of the ring 100 without departing from the scope of the invention. In addition, although the pad 110 of FIG. 1 has a particular size relative to the ring 100, pads 110 of an embodiment of the present invention may be sized differently, for example to account for the needs of a particular ring 100 wearer, without departing from the scope of the invention. In particular the pads 110 may be laterally or longitudinally resized in order to cover more or less of the inner surface 104 of the ring 100, and may also be thickened to provide additional cushioning, or thinned to reduce the level of cushioning, without departing from the scope of the invention.

Figure 3A:
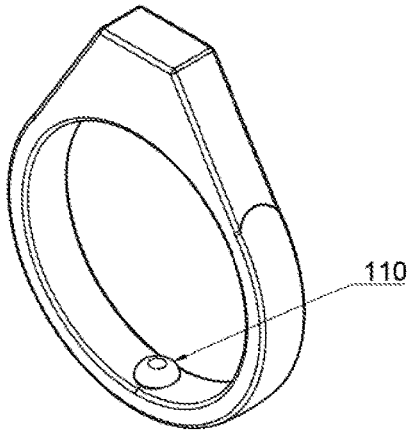
FIGS. 3A-3E depict a non-exhaustive range of exemplary arrangements of embodiments pads of the present invention.
Figure 3B:
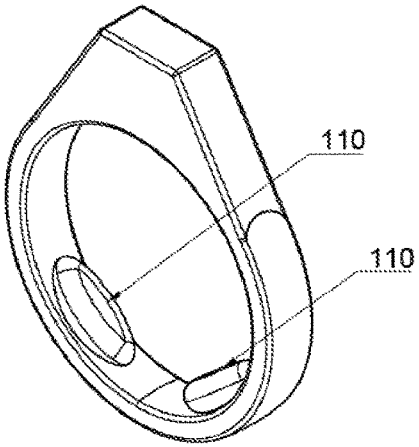
Figure 3C:
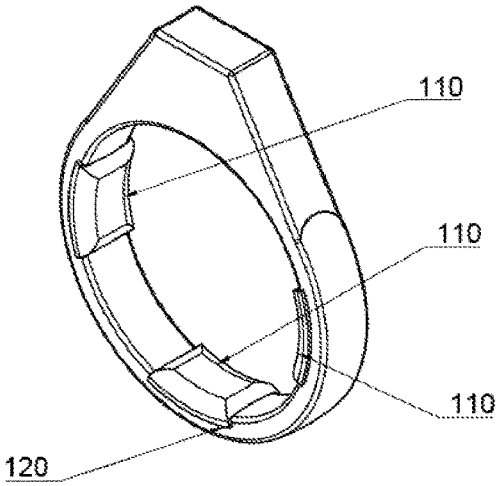
Figure 3D:
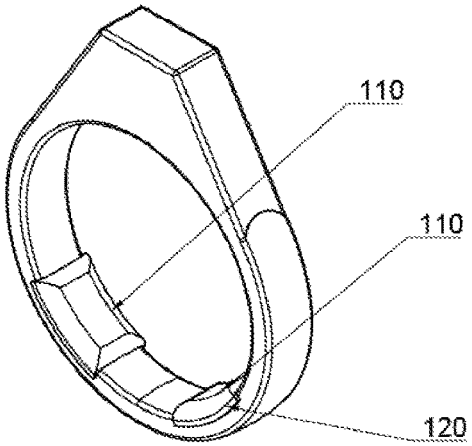
Figure 3E:
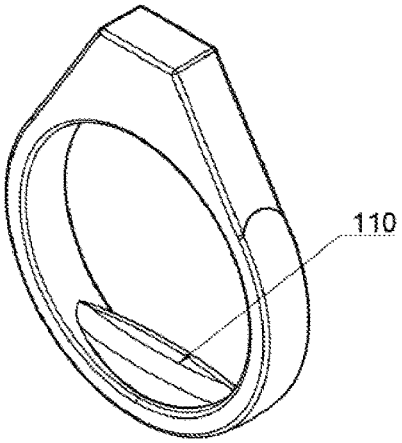

A non-exhaustive range of examples of pad sizes, shapes and arrangements may be found in FIGS. 3A-3E. FIGS. 3A & 3B depict two shapes that the pad 110 may be formed in, as well as some examples of differing number and arrangement of pads 110. FIGS. 3C & 3D depict varying numbers of pads 110 with ring lips 120. Ring lips 120, comprising extensions of the pad body 112 that at least partially 'wrap around' the shank of the ring 100, may aid in improving retention of the pad 110 upon the inner surface 104 of the ring. This may be through increasing surface area that remains in adhesive engagement with the ring. The ring lips 120 may also further improve the resistance of the pad 110 to being 'pushed off' of the inner surface 104 of the ring 100 as a finger is inserted into or removed from the ring. FIG. 3E depicts a ring 100 with a substantially larger pad 110 covering 100 a large proportion of the inner surface 104. This particular embodiment may be of use in fingers that undergo a large change in diameter, or may be of use in providing additional cushioning and comfort for people with frail or delicate fingers.

Figure 4:
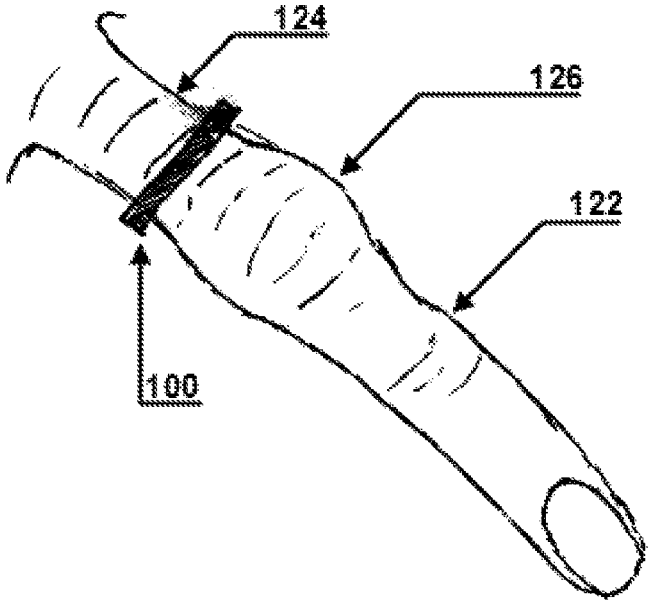
FIG. 4 depicts a ring upon a finger with a widened knuckle.

In use, at least one embodiment of the pad 110 of the present invention may permit for the ring 100 to be worn on a finger that has a proximal phalanx with a diameter substantially less than that of the finger knuckle. This may be seen in FIG. 4, depicting a ring finger 122 with a knuckle 126 that is wider than the proximal phalanx 124. A ring 100 will require an inner diameter greater than the diameter of knuckle 126 in order to fit onto the finger 122. However the diameter of the proximal phalanx 124 will not properly grip onto a ring 100 that does not have attached pads 110, and the ring 100 may be prone to spinning or rotating about the finger (thereby misaligning and/or hiding the setting 102 if the ring 100 possesses one), or otherwise may slip off of the finger. Attachment of the pads 110 (in any particular embodiment) to the inner surface 104 may permit the effective inner diameter of the ring 100 to be flexible and thereby adapt to the changing diameter as the ring 100 traverses the finger 122.

Figure 5:
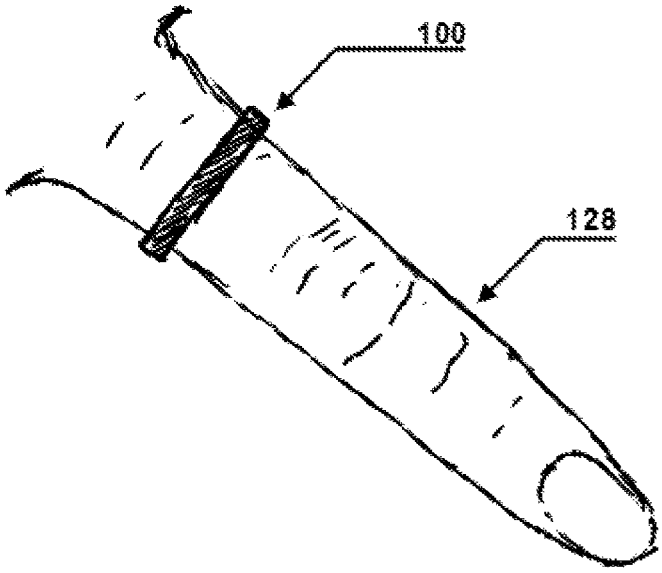
FIG. 5 depicts a ring upon a tapered finger.

At least one embodiment of the pad 110 of the present invention may also permit for the ring 100 to be worn on a finger that is tapered, as depicted in FIG. 5. A tapered finger 128, wherein the diameter of the finger 128 steadily increases from fingertip to base, suffers difficulties in wearing 100 a ring 100 in that the finger 128 lacks sufficient structure to prevent a ring 100 from slipping off. An embodiment of the present invention may assist in preventing loss of a ring 100 from a tapered finger 128, by providing an urging force between the finger 128 and the inner surface 104 of the ring 100 and increasing friction therebetween.

Figure 6A:
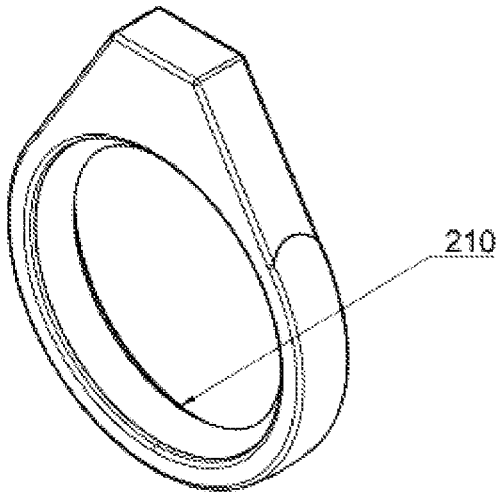
FIGS. 6A & 6B depict an embodiment of the pad of the present invention in the form of an inner pad ring.
Figure 6B:
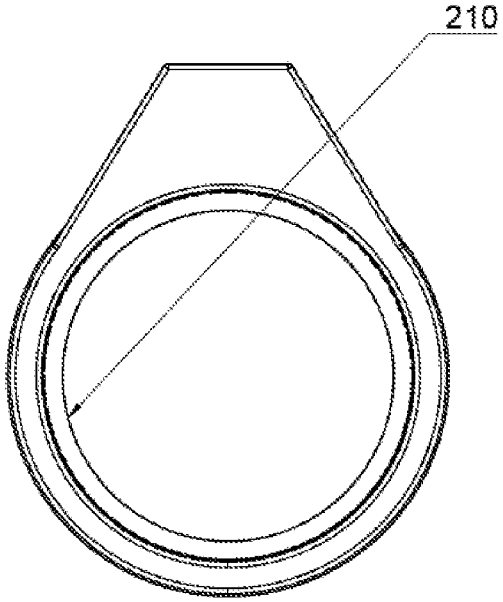

With reference to FIGS. 6A & 6B, in at least one embodiment, the pad 110 may cover substantially all of the inner surface 104 of the ring. This embodiment may provide protection against ring slippage, and may also assist in retention of the ring 100 upon a finger should the finger shrink due to, for example, a change in temperature. In such an embodiment, the applied pad 110 may form an 'inner pad ring' 210. In some embodiments, the inner pad ring 210 may cover the entire width of the inner surface 104 of the ring. In other embodiments, the pad 210 may only cover a portion of the width of the inner surface 104 of the ring. Without limiting the scope of the invention through theory, it is considered that the present embodiment may improve the ability of the ring 100 to be retained upon a finger without sliding off, in particular if the finger is tapered.

Figure 7A:
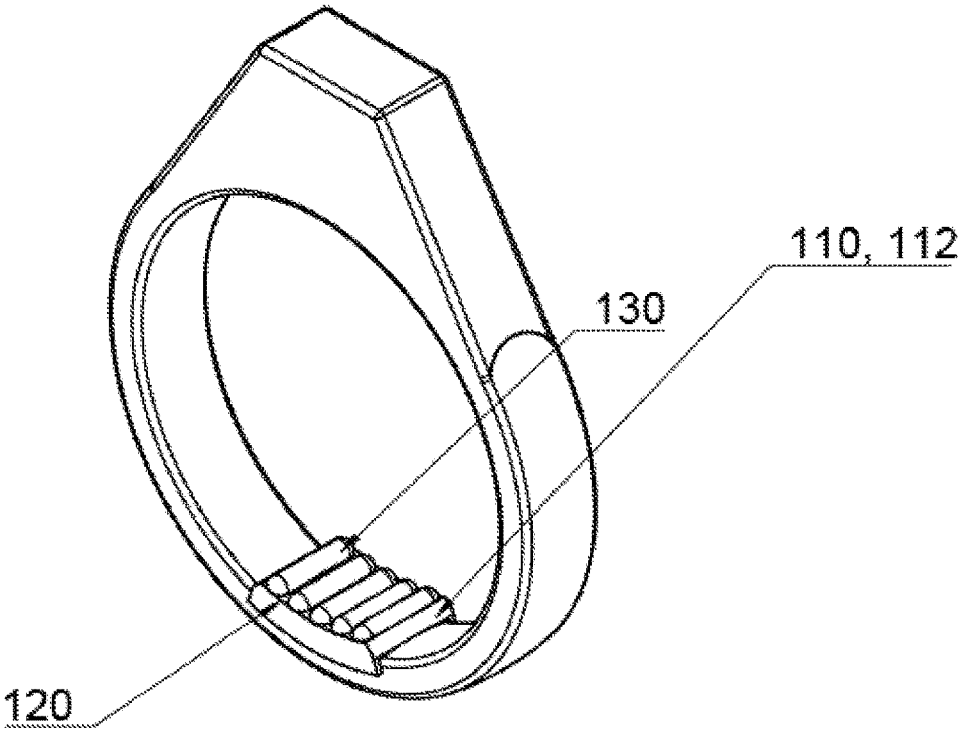
FIGS. 7A & 7B depict embodiments of the pad of the present invention comprising ridges.
Figure 7B:
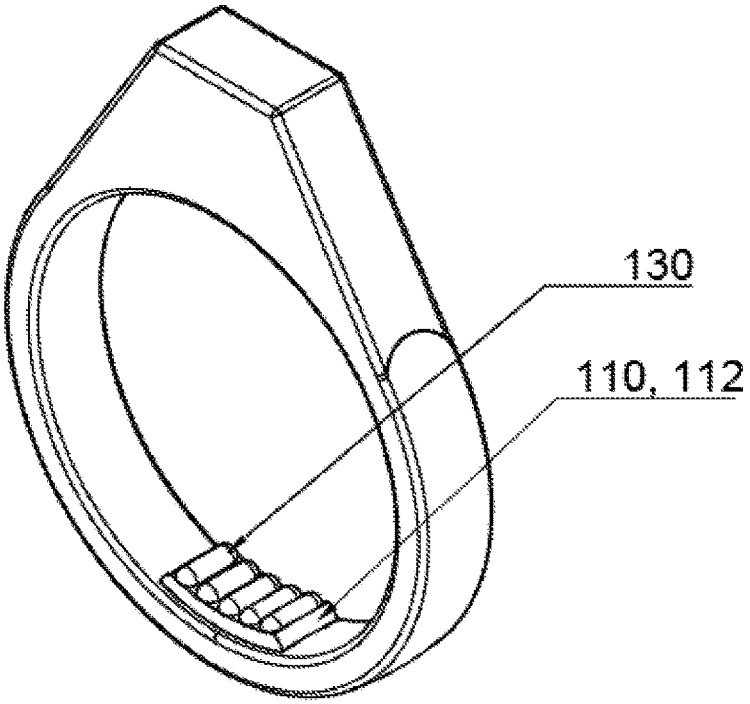

In various embodiments of the present invention, the pad 110 may comprise a range of surface structures 130. In one exemplary embodiment, the surface structure 130 may comprise one or more ridges, positioned on a finger-contacting surface of the pad body 112 adapted to improve grip between the pad 110 and the finger. Two exemplary embodiments may be seen in FIGS. 7A & 7B.

The surface structures 130 may be combined with other embodiments of the present invention. For example, although not shown, an embodiment of the present invention comprising an inner pad ring 210 may comprise ridges positioned on a finger-contacting surface.

Method of Forming a Pad Body of the Present Invention

A second aspect of the present invention relates to a method of producing a polysiloxane pad body 112 for attaching to an inner surface 104 of a ring 100, the method comprising the steps of pouring, injecting or otherwise inserting liquid, gel or putty polysiloxane into a mould; enabling the polysiloxane to set such that it forms into a solid polysiloxane pad body 112; and removing the formed pad body 112 from the mould.

In an embodiment, the mould may provide a plurality of pad 110 bodies. The pad 110 bodies may be removed from the mould as a 'sheet' of pad 110 bodies, such that individual pad 110 bodies may be removed as needed, without departing from the scope of the present aspect of the invention.

As the skilled person may appreciate, polysiloxanes may be set through a variety of different processes so as to alter the properties of the resulting solid polysiloxane. In one embodiment, the step of enabling the liquid, gel or putty polysiloxane to set may comprise a sub-step of vulcanising the polysiloxane. The vulcanising may be room-temperature vulcanising, sulfur vulcanising, peroxide vulcanising, alkoxy vulcanising, or any other process (or combination thereof) of vulcanising liquid, gel or putty polysiloxane to obtain a solid polysiloxane.

In an embodiment, the step of enabling the liquid, gel or putty polysiloxane to set may comprise a sub-step of catalysing the setting 102 process through providing a catalytic agent. In at least one embodiment, the catalytic agent may be a platinum-based catalyst. In an embodiment wherein the step of enabling the polysiloxane to set comprises a sub-step of vulcanising the polysiloxane, the catalytic agent may comprise an organotitanate catalyst, tin-based catalyst or other catalytic agent considered to be compatible with the particular vulcanising process being employed.

In an embodiment, the method of producing a polysiloxane pad body 112 may further comprise the step, following removal of the formed pad body 112 from the mould, of applying a surface treatment process. The step of applying a surface treatment process may comprise the application of post-cure treatment to remove at least a portion of polysiloxane curing 100 by-products. The post-cure treatment may comprise the step of applying heat to the formed pad body 112.

In an embodiment, the method of producing the polysiloxane pad body 112 may, following the step of pouring 100, injecting or otherwise inserting liquid, gel or putty polysiloxane into the mould, further comprise the additional step of providing a pad base 116 having an adhesive-receiving side and a pad-receiving side with one or more engaging surface features 118 for the polysiloxane to set, cure or otherwise harden in engagement with. The pad base 116 is inserted into, place on or otherwise introduced to the unset polysiloxane such that the one or more engaging surface features 118 are at least partially submerged within the unset polysiloxane. Upon the polysiloxane setting, curing or otherwise hardening into a solid pad body 112, the polysiloxane may remain in engagement with the engaging surface features 118 and so be retained by the pad base 116.

Method of Using a Pad of the Present Invention

A third aspect of the present invention provides a method of using a pad 110 to prevent a finger-ring 100 from rotating about or slipping off a finger on which the finger ring 100 is worn, comprising the steps of: applying at least one pad 110 comprising an elastically compressible pad body 112 and an adhesive layer 114 to a portion of an inner surface 104 of the finger-ring 100, whereby the adhesive layer 114 adheres to the inner surface 104 portion; allowing the adhesive layer 114 to set; and wearing the ring 100 upon the finger such that the pad body 112 compresses. In use, the compressed pad body 112 urges against the finger, thereby preventing, inhibiting or at least ameliorating rotation or movement of the finger-ring 100 about the finger. In at least one embodiment, the method may further comprise the step of applying an adhesive material to form the adhesive layer 114 prior to applying the pad 110 to the inner surface 104 of the ring.

In at least one embodiment of the third aspect of the invention, the pad body 112 is comprised of polysiloxane. In at least one embodiment of the invention, the adhesive comprises a liquid, gel or putty polysiloxane adhesive. In a further embodiment of the invention, both the pad body 112 and the adhesive are comprised of polysiloxane.

In an embodiment of the invention wherein at least the adhesive is comprised of polysiloxanes, the inner surface 104 may comprise a precious metal or other material that polysiloxane adhesive does not adhere to. In such a circumstance, the method of applying the invention may further comprise the step of, prior to the step of applying the pad body 112 to the inner surface 104 portion of the ring 100, applying an etching primer to a portion of the inner surface 104 of the finger ring 100 so as to prime the inner surface 104 portion. This may enable a polysiloxane adhesive to adhere to the material of the inner surface 104 of the ring.

In an embodiment of the invention wherein the pad body 112 is comprised of one or more polysiloxanes but the adhesive is not, the pad 110 may further comprise a pad base 116 having an adhesive-receiving side and a pad-receiving side engaged with and retaining the pad body 112. In such an embodiment, the method may comprise the step of applying the adhesive to the adhesive-receiving side of the pad base 116 instead of the step of applying the adhesive directly to the pad body 112. The pad base 116 may comprise one or more engaging surface features 118 configured to engage with and retain the pad body 112.

In an embodiment where both the pad body 112 and adhesive are polysiloxane-based, the present invention may provide a method of attaching a polysiloxane pad 110 to an inner surface 104 portion of a finger-ring 100 comprising the steps of: applying a liquid, gel or putty polysiloxane adhesive to a surface of an elastically compressible pad body 112 comprised of polysiloxane so as to form an adhesive layer 114 on the pad 110 surface; applying the pad body 112 to the inner surface 104 portion such that the adhesive layer 114 contacts the inner surface 104 portion; allowing the liquid, gel or putty polysiloxane of the adhesive layer 114 to set and form a solid polysiloxane; and wearing 100 the ring 100 upon the finger such that the pad body 112 compresses.

A Kit Comprising a Pad of the Present Invention

A fourth aspect of the present invention may comprise a kit for a user to attach a pad 110 to a finger-ring 100. In at least one embodiment, the kit may comprise a pad 110 having a pad body 112 and an adhesive layer 114, with an adhesive-preserving seal covering the adhesive layer 114. In an alternate embodiment, the kit may comprise a pad body 112 and a separate portion of adhesive material to be applied by the user to form an adhesive layer 104.

In one embodiment, the pad body 112 is comprised of polysiloxane or a polysiloxane-based material. In an embodiment wherein the pad body 112 is comprised of polysiloxane or a polysiloxane-based material, the kit may further comprise a pad base 116 in engagement with the pad body 112. The pad base 116 may have an adhesive-receiving side and a pad-receiving side with one or more engaging surface features 118 that the pad body 112 is engaged with.

The present invention has been described with particular reference to rings to be worn upon fingers. However, as the skilled person will appreciate, embodiments of the present invention are applicable to rings that are designed to be worn upon a toe, and adaptation of an embodiment to be applicable to a ring 100 for wearing 100 upon a toe, even though it may not be explicitly disclosed, is within the scope of the invention.

While the invention has been described with reference to preferred embodiments above, it will be appreciated by those skilled in the art that it is not limited to those embodiments, but may be embodied in many other forms, variations and modifications other than those specifically described. The invention includes all such variation and modifications. The invention also includes all of the steps, features, components and/or devices referred to or indicated in the specification, individually or collectively and any and all combinations or any two or more of the steps or features.

In this specification, unless the context clearly indicates otherwise, the word "comprising" is not intended to have the exclusive meaning of the word such as "consisting only of", but rather has the non-exclusive meaning, in the sense of "including at least". The same applies, with corresponding grammatical changes, to other forms of the word such as "comprise", etc.

Other definitions for selected terms used herein may be found within the detailed description of the invention and apply throughout. Unless otherwise defined, all other scientific and technical terms used herein have the same meaning as commonly understood to one of ordinary skill in the art to which the invention belongs.

Any promises made in the present document should be understood to relate to some embodiments of the invention, and are not intended to be promises made about the invention in all embodiments. Where there are promises that are deemed to apply to all embodiments of the invention, the applicant/patentee reserves the right to later delete them from the description and they do not rely on these promises for the acceptance or subsequent grant of a patent in any country.

The invention claimed is:

1. A pad to be applied to an inner surface of a finger-ring, the pad comprising:

an elastically compressible pad body comprising at least one polysiloxane;

a polysiloxane adhesive layer adapted to adhere to the inner surface of the finger-ring; and a pad base between said pad body and said polysiloxane adhesive layer, said pad base being configured to engage with and retain said pad body;

wherein said pad body and said polysiloxane adhesive layer are comprised of polysiloxanes having substantially similar chemical formulae;

wherein said pad body is shaped to inhibit flexion thereof upon insertion of a finger into and withdrawal from the finger-ring, respectively;

wherein said pad body is compressed upon the finger-ring being worn upon a finger, whereby the compressed pad body is urged against the finger, such that rotation and movement of the finger-ring about and along the finger is inhibited.

2. The pad of claim 1, wherein said at least one polysiloxane is selected from the group consisting of at least one silicone rubber, silicone resin, silicone foam and silicone sponge.

3. The pad of claim 1, wherein said pad base comprises at least one engageable surface feature that engages with and retains said pad body.

4. The pad of claim 3, wherein said at least one of the engageable surface feature is selected from the group consisting of a contusion, protrusion and ridge which contacts said pad body when in a state selected from the group consisting of a liquid, gel and putty state; and upon said pad body transitioning into a solid state, said pad body engages with, and is retained against said pad base by said engageable surface feature.

5. The pad of claim 4, wherein said pad body has a finger-contacting surface feature comprising a plurality of ridges.

6. The pad of claim 4, wherein said pad body has a finger-contacting surface feature comprising a plurality of protrusions.

7. The pad of claim 1, wherein said polysiloxane adhesive layer comprises a polysiloxane adhesive in a state selected from the group consisting of a liquid, gel and putty state; and wherein said adhesive is transitionable into a solid polysiloxane state after contacting the inner surface of the finger-ring, thereby adhering said pad body to the inner surface of the finger-ring.

8. The pad of claim 1, wherein said pad body is sized to cover substantially all of the inner surface of the finger-ring.

9. A method of preventing a finger-ring from rotating about and slipping off a finger on which the finger-ring is worn, the method comprising the following steps:

applying an etching primer to a portion of the inner surface of the finger-ring so as to prime the inner surface portion and enable said polysiloxane adhesive layer to adhere to the inner surface portion of the finger-ring;

applying at least one pad comprising an elastically compressible pad body which comprises at least one polysiloxane and a polysiloxane adhesive layer to the primed inner surface portion of the inner surface of the finger-ring, whereby the polysiloxane adhesive layer adheres said pad body to said inner surface portion of the finger-ring and wherein said pad body is shaped to inhibit flexion thereof upon insertion and withdrawal of a finger into and from the finger-ring, respectively;

allowing said polysiloxane adhesive layer to set;

placing the finger-ring upon the finger, thereby compressing said pad body whereby said compressed pad body is urged against the finger, preventing rotation and movement of said finger-ring about and along the finger.

10. The method of claim 9, additionally comprising the step of:

prior to the step of applying said pad body to the inner surface portion of the ring, initially applying the polysiloxane adhesive material to said pad body so as to form said polysiloxane adhesive layer.

11. A kit for a user to attach a pad to an inner surface portion of a finger-ring, comprising:

a pad having a polysiloxane pad body;

polysiloxane adhesive material to form a polysiloxane adhesive layer between said pad and the inner surface portion of the finger-ring;

said pad body being shaped to inhibit flexion thereof upon insertion and withdrawal of a finger from the finger-ring, respectively; and an etching primer to enable said polysiloxane adhesive material to adhere to an inner surface portion of a finger-ring comprised of a member selected from the group consisting of a precious metal and other material that is ordinarily substantially inert to a polysiloxane adhesive.

12. The kit of claim 11, further comprising a pad base in engagement with said pad body;

said pad base comprising an adhesive-receiving side for said polysiloxane adhesive material to be applied thereto so as to form a polysiloxane adhesive layer.

13. The kit of claim 11, wherein said polysiloxane adhesive material is provided as a polysiloxane adhesive layer, the with said kit further comprising an adhesive-preserving seal covering said polysiloxane adhesive layer.

14. A pad configured to be affixed to an etchingly-primed inner surface portion of a finger-ring, said pad comprising:

an elastically compressible pad body comprising at least one polysiloxane, said pad body being shaped to inhibit flexion thereof upon insertion into and withdrawal of a finger from said finger-ring, respectively;

a polysiloxane adhesive layer adapted to adhere to said etchingly-primed inner surface portion of said finger-ring;

an etching primer for etchingly priming the inner surface portion of said finger-ring, and wherein upon said finger-ring being worn upon a finger, said pad body is compressed, and said compressed pad body is biased against said finger, such that rotation and movement of the finger-ring about and along the finger is inhibited.

* * * * *